US006233411B1

(12) United States Patent
Scheuer et al.

(10) Patent No.: US 6,233,411 B1
(45) Date of Patent: May 15, 2001

(54) METHOD AND APPARATUS FOR STABILIZING PRODUCTIVITY OF AN ELECTROSTATOGRAPHIC TONER IMAGE REPRODUCTION MACHINE

(75) Inventors: Mark A. Scheuer, Williamson; Debbie S. Wickham, Victor, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/588,817

(22) Filed: Jun. 7, 2000

(51) Int. Cl.[7] ..... G03G 15/06
(52) U.S. Cl. ..... 399/58; 399/59; 430/120
(58) Field of Search ..... 399/58, 62, 61, 399/27, 29, 30, 59; 430/120

(56) References Cited

U.S. PATENT DOCUMENTS

| | | | | |
|---|---|---|---|---|
| 4,434,221 | | 2/1984 | Oka | 430/122 |
| 4,492,179 | | 1/1985 | Folkins et al. | 118/689 |
| 4,619,522 | | 10/1986 | Imai . | |
| 4,734,737 | * | 3/1988 | Koichi | 399/58 |
| 6,134,398 | * | 10/2000 | Grace | 399/58 |
| 6,160,970 | * | 12/2000 | Scheuer et al. | 399/27 X |
| 6,160,971 | * | 12/2000 | Scheuer et al. | 399/27 X |
| 6,167,214 | * | 12/2000 | Scheuer et al. | 399/27 X |
| 6,169,861 | * | 1/2001 | Hamby et al. | 399/58 |
| 6,173,133 | * | 1/2001 | Donaldson et al. | 399/58 |

* cited by examiner

*Primary Examiner*—Susan S. Y. Lee
(74) *Attorney, Agent, or Firm*—Tallam I. Nguti

(57) ABSTRACT

A distributive pitch skipping method and apparatus for stabilizing productivity in an electrostatographic printing machine. The method and apparatus provide for establishing a first toner concentration (TC) limit at and below which toner image reproduction of the machine stops and the machine dead cycles; establishing a second TC limit, higher than the first TC limit, above which the toner image reproduction rate of the machine is 100% at ST ppm (Standard prints per minute); adding fresh toner into a developer housing of the machine in an attempt to maintain the TC of the developer housing above the second TC limit while running copies having various toner area coverage levels; and establishing at least a third TC limit, between the first TC limit and the second TC limit, above which the toner image reproduction rate is less than 100% at (ST-X1) ppm, and below which the toner image reproduction rate is less than 100% at (ST-X2) ppm, where X1 and X2 are integers, and X2 is greater than X1.

11 Claims, 5 Drawing Sheets

METHOD AND APPARATUS FOR STABILIZING PRODUCTIVITY OF AN ELECTROSTATOGRAPHIC TONER IMAGE REPRODUCTION MACHINE

BACKGROUND OF THE INVENTION

This invention relates to electrostatographic toner image reproduction machines, and more particularly to such a machine including a method and apparatus for stabilizing productivity in the face of declining toner concentration, thereby deterring dead cycling and thus assuring operator satisfaction.

In electrostatographic toner image reproduction machines such as copiers and printers, toner reproductions are made using toner particles, contained in developer material at a desired concentration level. As toner particles are depleted from the developer material, additional toner particles must be added thereto in order to maintain the toner concentration at the desired level. Typically, the toner concentration of a machine is monitored by suitable means, and is maintained by adding fresh toner particles to the development housing of the machine.

For monitoring and maintaining the toner concentration of such a machine, many types of systems including high cost toner concentration sensors, have been proposed. For example, U.S. Pat. No. 4,619,522 to Imai teaches the use of a reference pattern, with a predetermined reflectance, that is developed. Subsequently, the density of the developed pattern is detected by a sensor, and used to regulate the replenishment of toner to the developer housing.

Furthermore, U.S. Pat. No. 4,434,221 to Oka discloses a method of utilizing a reference latent image to measure the current flow between the developing sleeve and the photoreceptor drum during development of the reference image. Subsequently, the amount of toner needed for replenishment is controlled, based on the current value measured. Oka further characterizes this method as inferior, because, the variation in current value due to toner concentration is exceeded by the variation due to the amount of toner adhering to the reference image.

In addition, U.S. Pat. No. 4,492,179 to Folkins et al., teaches the sensing of the charge of the toner particles being transferred to the latent image, and means for controlling the addition of toner to the developer housing as a function of that measurement. Folkins et al. also discloses the limitations of the marking particle dispense control system, relating to toner dispensing assumptions, in which the rate of dispense must remain constant over the life of the system. More specifically, any variation in the toner mass dispensed for a given electrical input will manifest itself proportionally as a shift in the relationship between the toner dispense rate and the bias current required for the developed toner charge.

Unfortunately however, toner depletion or consumption can and often outstrips toner replenishment particularly when running long jobs with relatively high toner area coverage. Typically, the response of conventional machines is to dead cycle, or to skip a bunch of pitches when a certain trigger is reached. This approach has been found to cause operator dissatisfaction. In other words, in existing xerographic print engines, when a control point falls too far from target and print quality is expected to suffer, the print engine goes into a dead cycle mode turning off customer prints while the system recovers using normal or accelerated process controls.

There is therefore a need for an electrostatographic toner image reproduction machines, and more particularly to such a toner image reproduction machine having a distributed pitch skipping method and apparatus for preventing dead cycling and thus assuring operator satisfaction.

SUMMARY OF THE INVENTION

In accordance with the present invention, there is provided an electrostatographic toner image reproduction machine having a distributive pitch skipping method and apparatus for stabilizing productivity in an electrostatographic printing machine. The method and apparatus provide for establishing a first toner concentration (TC) limit at and below which toner image reproduction of the machine stops and the machine dead cycles; establishing a second TC limit, higher than the first TC limit, above which the toner image reproduction rate of the machine is 100% at ST ppm (Standard prints per minute); adding fresh toner into a developer housing of the machine in an attempt to maintain the TC of the developer housing above the second TC limit while running copies having various toner area coverage levels; and establishing at least a third TC limit, between the first TC limit and the second TC limit, above which the toner image reproduction rate is less than 100% at (ST-X1) ppm, and below which the toner image reproduction rate is less than 100% at (ST-X2) ppm, where X1 and X2 are integers, and X2 is greater than X1.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
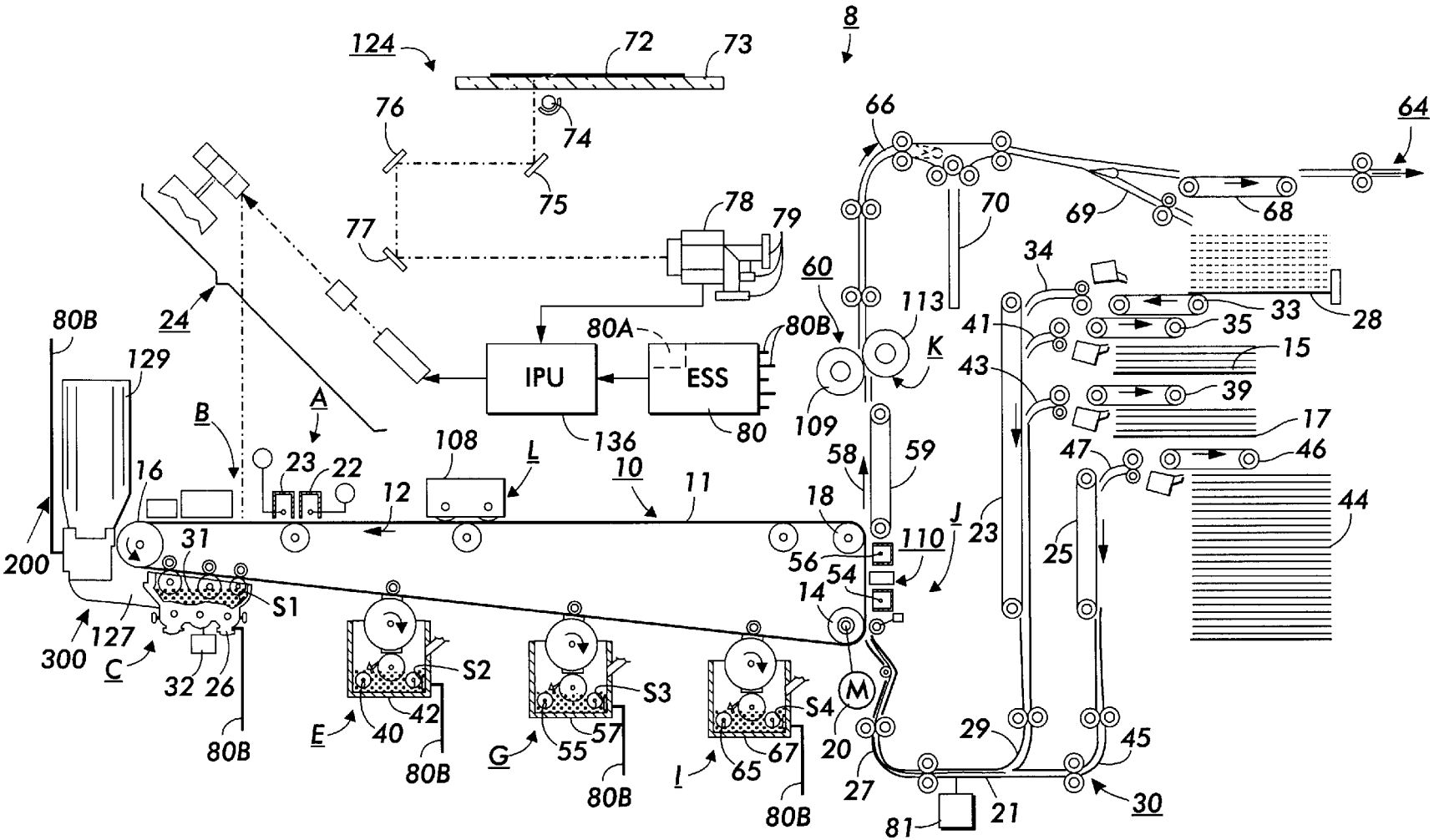
FIG. 1 is a schematic elevational view of a high volume toner image reproduction machine including the productivity stabilizing method and apparatus of the present invention.

Referring to FIG. 1, there is depicted an exemplary electrostatographic reproduction machine, such as a multipass color electrostatographic reproduction machine 8. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light.

The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS) 80.

The ESS is preferably a self-contained, dedicated mini-computer having a central processor unit (CPU), electronic storage, and a display or user interface (UI). The ESS is the control system which with the help of sensors and connections 80B as well as a dedicated processor or controller 80A of the present invention, reads, captures, prepares and manages the image data flow between IPU 136 and image input terminal 124. In addition, the ESS 80 is also the main multi-tasking processor for operating and controlling all printing operations and all of the other machine subsystems including the method and apparatus (to be described below) of the present invention for stabilizing machine productivity in the face of declining toner concentration.

The multipass color electrostatographic reproduction machine 8 employs a photoreceptor 10 in the form of a belt having a photoconductive surface layer 11 on an electroconductive substrate. Preferably the surface 11 is made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counter-clockwise direction as shown by arrow 12.

Initially, in a first imaging pass, the photoreceptor 10 passes through charging station A where a corona generating devices, indicated generally by the reference numeral 22, 23, on the first pass, charge photoreceptor 10 to a relatively high, substantially uniform potential. Next, in this first imaging pass, the charged portion of photoreceptor 10 is advanced through an imaging station B. At imaging station B, the uniformly charged belt 10 is exposed to the scanning device 24 forming a latent image by causing the photoreceptor to be discharged in accordance with one of the color separations and bit map outputs from the scanning device 24, for example black. The scanning device 24 is a laser Raster Output Scanner (ROS). The ROS creates the first color separation image in a series of parallel scan lines having a certain resolution, generally referred to as lines per inch. Scanning device 24 may include a laser with rotating polygon mirror blocks and a suitable modulator, or in lieu thereof, a light emitting diode array (LED) write bar positioned adjacent the photoreceptor 10.

At a first development station C, a non-interactive developer housing, indicated generally by the reference numeral 26, advances developer material 31 containing carrier particles and charged toner particles at a desired and controlled concentration into contact with a donor roll, and the donor roll then advances charged toner particles into contact with the latent image and any latent target marks. Developer housing 26 may have a plurality of magnetic brush and donor roller members, plus rotating augers or other means for mixing toner and developer. A special feature of non-interactive development is that adding and admixing can continue even when development is disabled. Therefore the timing algorithm for the adding and admixing function can be independent of that for the development function, as long as admixing is enabled whenever development is required. The donor roller members of the housing 26 transport negatively charged black toner particles for example, to the latent image for development thereof which tones the particular (first) color separation image areas and leaves other areas untoned.

Power supply 32 electrically biases developer housing 26. Development or application of the charged toner particles as above typically depletes the level and hence concentration of toner particles, at some rate, from developer material in the developer housing 26. This is also true of the other developer housings (to be described below) of the machine 8.

Accordingly, different jobs of several documents being reproduced, will cause toner depletion at different rates depending on the sustained, copy sheet toner area coverage level of the images thereof being reproduced. In a machine using two component developer material as here, such depletion undesirably changes the concentration of such particles in the developer material. In order to attempt to maintain the concentration of toner particles within the developer material (in an attempt to insure the continued quality of subsequent images), the adding and admixing function of the developer housing must be operating or turned "on" for some controlled period of time in order for a fresh toner replenisher 129 (including an auger 127) to replenish the developer housing, such as 26, with fresh toner particles. Such fresh toner particles must then be admixed with the carrier particles within the developer housing 26 in order to properly charge them triboeletrically.

On the second and subsequent passes of the multipass machine 8, the pair of corona devices 22 and 23 are employed for recharging and adjusting the voltage level of both the toned (from the previous imaging pass), and untoned areas on photoreceptor 10 to a substantially uniform level. A power supply is coupled to each of the electrodes of corona recharge devices 22 and 23. Recharging devices 22 and 23 substantially eliminate any voltage difference between toned areas and bare untoned areas, as well as to reduce the level of residual charge remaining on the previously toned areas, so that subsequent development of different color separation toner images is effected across a uniform development field.

Imaging device 24 is then used on the second and subsequent passes of the multipass machine 8, to superimpose subsequent a latent image of a particular color separation image, by selectively discharging the recharged photoreceptor 10. The operation of imaging device 24 is of course controlled by the controller, ESS 80. One skilled in the art will recognize that those areas developed or previously toned with black toner particles will not be subjected to sufficient light from the imaging device 24 as to discharge the photoreceptor region lying below such black toner particles.

Thus on a second pass, imaging device 24 records a second electrostatic latent image on recharged photoreceptor 10. Of the four developer housings, only the second developer housing 42, disposed at a second developer station E, has its development function turned "on" (and the rest turned "off") for developing or toning this second latent image. As shown, the second developer housing 42 contains negatively charged developer material 40, for example, one including yellow toner. Toner from the developer material 40 contained in the developer housing 42 is thus transported by a donor roll as shown to the second latent image recorded on the photoreceptor 10, thus forming additional toned areas of the particular color separation on the photoreceptor 10.

A power supply (not shown) electrically biases the developer housing 42 to develop this second latent image with the negatively charged yellow toner particles from developer material 40. As will be further appreciated by those skilled in the art, the yellow colorant is deposited immediately subsequent to the black so that further colors that are additive to yellow, and interact therewith to produce the available color gamut, can be exposed through the yellow toner layer.

On the third pass of the multipass machine 8, the pair of corona recharge devices 22 and 23 are again employed for recharging and readjusting the voltage level of both the toned and untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas, as well as to reduce the level of residual charge remaining on the previously toned areas so that subsequent development of different color toner images is effected across a uniform development field.

A third latent image is then again recorded on photoreceptor 10 by imaging device 24. With the development functions of the other developer housings turned "off", this image is developed in the same manner as above using a third color toner in a third developer material 55 contained in a developer housing 57 disposed at a third developer station G. An example of a suitable third color toner is magenta. Suitable electrical biasing of the developer housing 57 is provided by a power supply, not shown.

On the fourth pass of the multipass machine 8, the pair of corona recharge devices 22 and 23 again recharge and adjust the voltage level of both the previously toned and yet untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas as well as to reduce the level of residual charge remaining on the previously toned areas.

A fourth latent image is then again created using imaging device 24. The fourth latent image is formed on both bare areas and previously toned areas of photoreceptor 10 that are to be developed with the fourth color image. This image is developed in the same manner as above using, for example, a cyan color toner in a developer material 65 contained in developer housing 67 at a fourth developer station I. Suitable electrical biasing of the developer housing 67 is provided by a power supply, not shown.

Following the black developer housing 26, developer housings 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. In order to condition the toner for effective transfer to a substrate, a negative pre-transfer corotron member 50 negatively charges all toner particles to the required negative polarity to ensure proper subsequent transfer.

Since the machine 8 is a multicolor, multipass machine as described above, only one of the plurality of developer housings, 26, 42, 57 and 67 may have its development function turned "on" and operating during any one of the required number of passes, for a particular color separation image development. The remaining developer housings must thus have their development functions turned off.

Still referring to FIG. 1, during the exposure and development of the last color separation image, for example by the fourth developer housing 67 a sheet of support material S is advanced towards a transfer station J by a sheet feeding apparatus 30. During simplex operation (single sided copy), a blank sheet S may be fed from tray 15 or tray 17, or a high capacity tray 44 thereunder, to a registration transport 21, in communication with controller 81, where the sheet is registered in the process and lateral directions, and for skew position. One skilled in the art will realize that trays 15, 17, and 44 may each hold a different sheet type, for example, sheets of varying thickness, weight and hence stiffness. The speed of the sheet S is adjusted at registration transport 21 so that the sheet arrives at transfer station J in synchronization with the composite multicolor image on the surface of photoconductive belt 10.

Registration transport 21 can receive a sheet—from either a vertical transport 23 or a high capacity tray transport 25 and moves the received sheet path 27 to a pre-transfer nip assembly as shown. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet—from trays 15 and 17 to the vertical transport 23 by chutes 41 and 43. The high capacity tray transport 25 receives the sheet from tray 44 and guides it to the registration transport 21, with all sheets moving passed a sheet sensor 81.

Referring still to FIG. 1, transfer station J includes a transfer corona device 54 which provides positive ions to the backside of the copy sheet. This attracts the negatively charged toner powder images from photoreceptor belt 10 to the sheet. A detack corona device 56 is provided for facilitating stripping of the sheet from belt 10.

A sheet-to-image registration detector 110 is located in the gap between the transfer and corona devices 54 and 56 to sense variations in actual sheet to image registration and provides signals indicative thereof to ESS 80 and sensor 81 while the sheet is still tacked to photoreceptor belt 10. After transfer, the sheet continues to move, in the direction of arrow 58, onto a conveyor 59 that advances the sheet to fusing station K.

Fusing station K includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder image contacting fuser roller 109. In this manner, the multi-color toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station J, in the same manner as the image was deposited on the first side thereof. The completed duplex copy exits to the finishing module (not shown) via output 64.

Meanwhile, after the sheet of support material is separated from photoreceptor 10, the residual toner carried on the photoreceptor surface is removed therefrom. The toner is removed at cleaning station L using a cleaning brush structure contained in a unit 108

In the above described process as is well known, the development of a latent image with toner, depletes or uses up an amount of toner contained in the multicomponent developer material in the development housing 26, 42, 57, 67. As is known, the amount or quantity of toner remaining in each housing 26, 42, 57, 67 determines the toner concentration of the developer material therein. As is also well known, the toner concentration of each housing is critical for the machine's ability to produce acceptable quality toner reproductions of images of document sheets.

Therefore, the machine 8 includes a toner concentration control apparatus 200 including the controller or ESS 80 and the fresh toner replenisher assembly 129 for each developer housing 26, 42, 57, 67. As shown, the replenisher assembly 129 for each developer housing 26 , 42 , 57 , 67 is connected to the controller 80, for the purpose of attempting to maintain the toner concentration of developer material (in each such developer housing 26, 42, 57, 67) within a desired range. Such a desired range is defined for example by an upper limit TCU above which the addition or replenishment of fresh toner by auger 127 ceases or is stopped, and a lower limit TCL (FIGS. 2, 3, and 4) at and below which machine productivity stops and the developer housing, and hence the machine "dead cycles".

As further shown, the toner concentration control apparatus 200 includes a toner concentration sensor S1, S2, S3, S4 for each housing 26, 42, 57, 67, and of course the controller 80. With these elements, toner concentration control is accomplished by using a combination of feed forward continuous tone (contone) byte counting from the image path of the ESS 80, and feedback from the toner concentration sensor S1, S2, S3, S4 that as shown is located within the sump of its respective developer housing 26, 42, 57 and 67, and that for example measures magnetic permeability of the developer material therein.

As shown, the sensor S1, S2, S3, S4 is imbedded in a well-behaved region of developer flow within the sump. Readings are acquired on a fixed time basis after an appropriate delay following startup of the drive of the developer housing 26, 42, 57, 67 in order to ensure that a proper developer flow is established past the sensor. The magnetic permeability readings from the sensor are then converted by the ESS 80 into toner concentration (TC) readings. Corrections if necessary are made for sensor temperature, humidity in the machine cavity, and developer material age. Each corrected TC reading is then compared to a target, for example on a look up table of the ESS 80, and the error is used to determine a new fresh toner replenishment rate (TRR).

The toner replenisher 129 then responsively attempts to deliver both a determined amount of fresh toner (with some fresh carrier) to the developer housing 26, 42, 57, 67. As illustrated, the toner replenisher 129 for each color developer material 31, 40, 55, 65 (shown only for developer housing 26 but same for the others) includes a toner bottle that is turned upside down for filling a hopper, and the replenishment auger 127 that carries the fresh toner (and some carrier) to the developer housing 26, 42, 57, 67.

A stepper motor (not shown) is used to drive the replenishment auger 127 of each housing 26, 42, 57, 67. Below a flow rate of 10%, the replenishment rate of each auger 127 has been found to be somewhat erratic. However, the flow rate of each auger 127 can be adjusted in 1% increments from a flow rate of about 10% to 100%, where 100% is designed to deliver fresh toner at the rate at which toner image reproductions having 100% area coverage are depleting or removing toner from the developer housing. Designers however have no control over the actual area coverage of toner image reproductions in any particular job or jobs to be run by a machine operator, as well as no control on how long such a job or jobs are.

Figure 4:
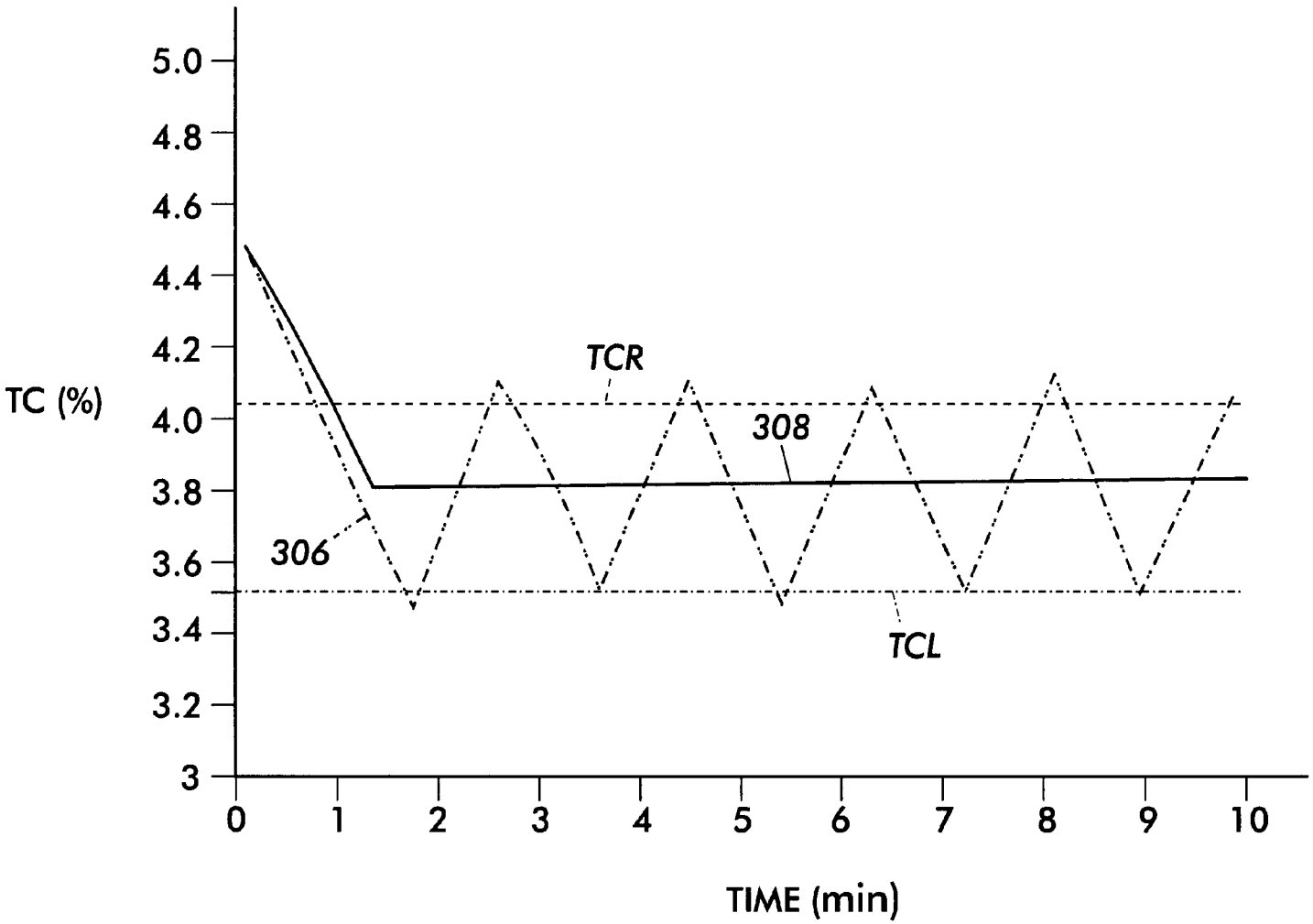
FIG. 4 is a comparative graphical illustration of Toner Concentration variations over time between a "Dead Cycling" method and the productivity stabilizing method of the present invention, at 100% area coverage and a 50% replenishment rate.
Figure 5:
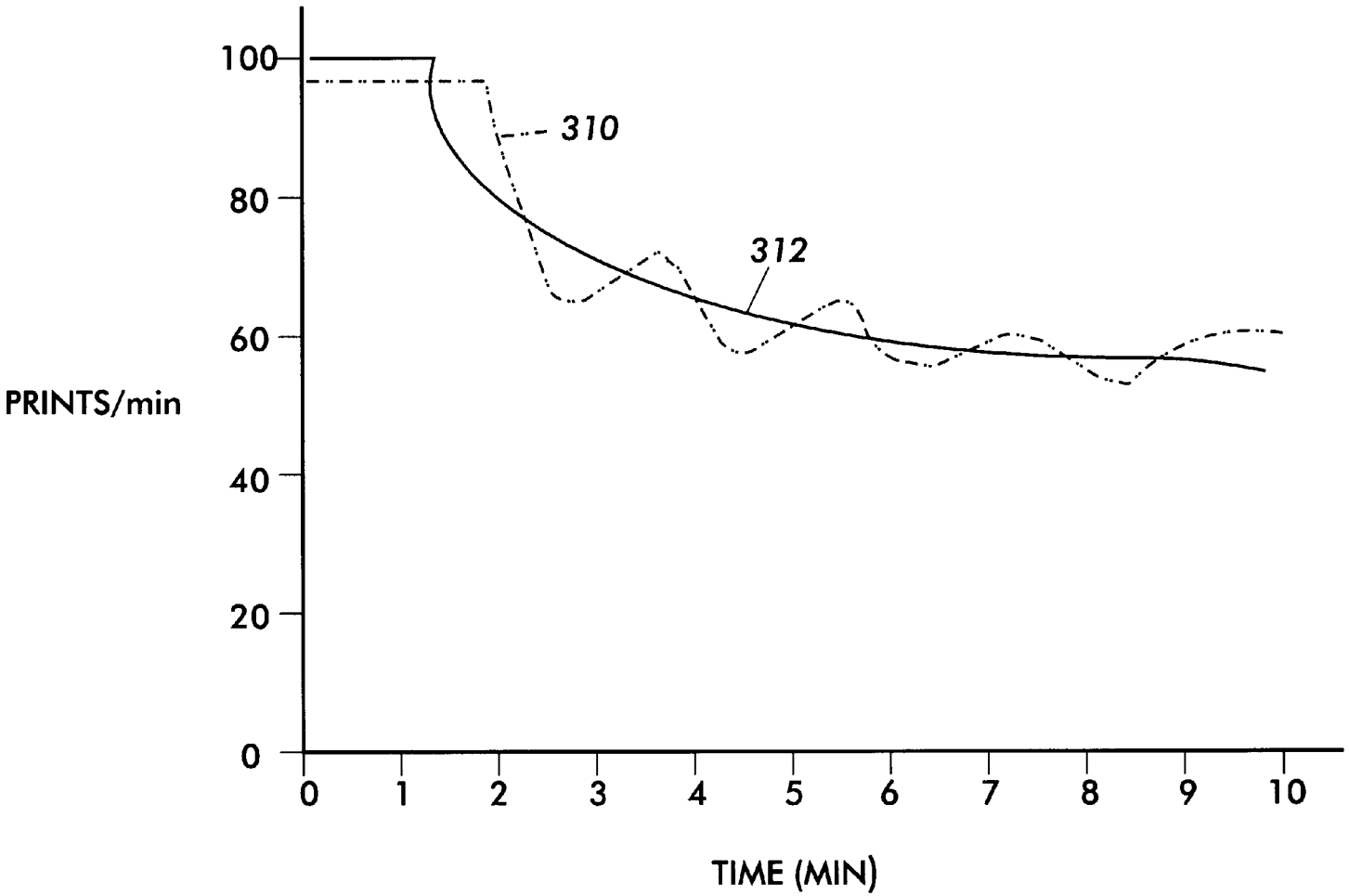
FIG. 5 is a comparative graphical illustration (of productivity of the machine of FIG. 4) between the "Dead Cycling" method, and the productivity stabilizing method of the present invention.

Therefore, as is illustrated comparatively in FIGS. 4 and 5, machine productivity based only on toner concentration control as above within a desired range, does not guarantee against occasional "dead cycling", and hence can be unstable with frequent, significant stops and starts, thus causing obvious operator dissatisfaction.

Figure 2:
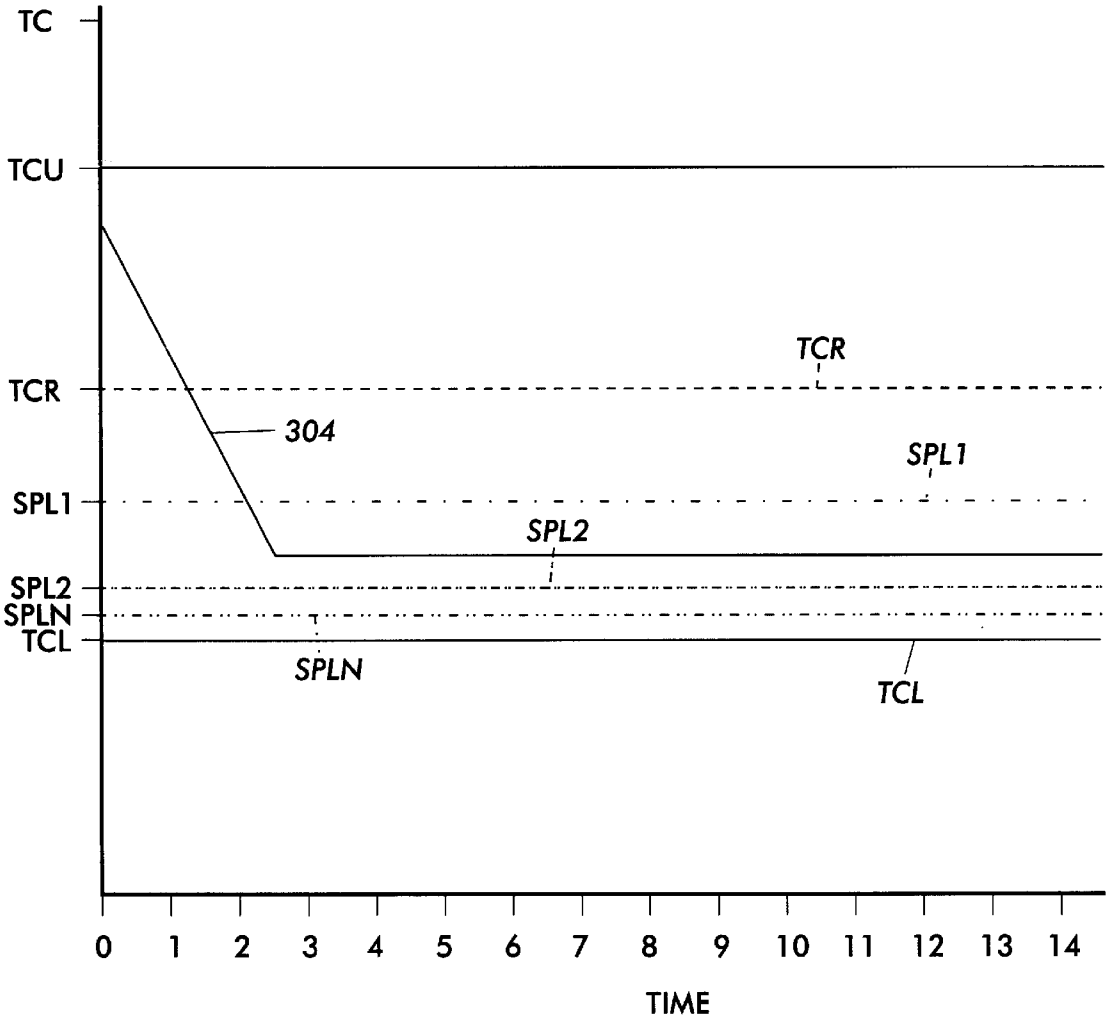
FIG. 2 is a graphical illustration of the toner concentration variations over time of the machine of FIG. 1 under the method and apparatus of the present invention.
Figure 3:
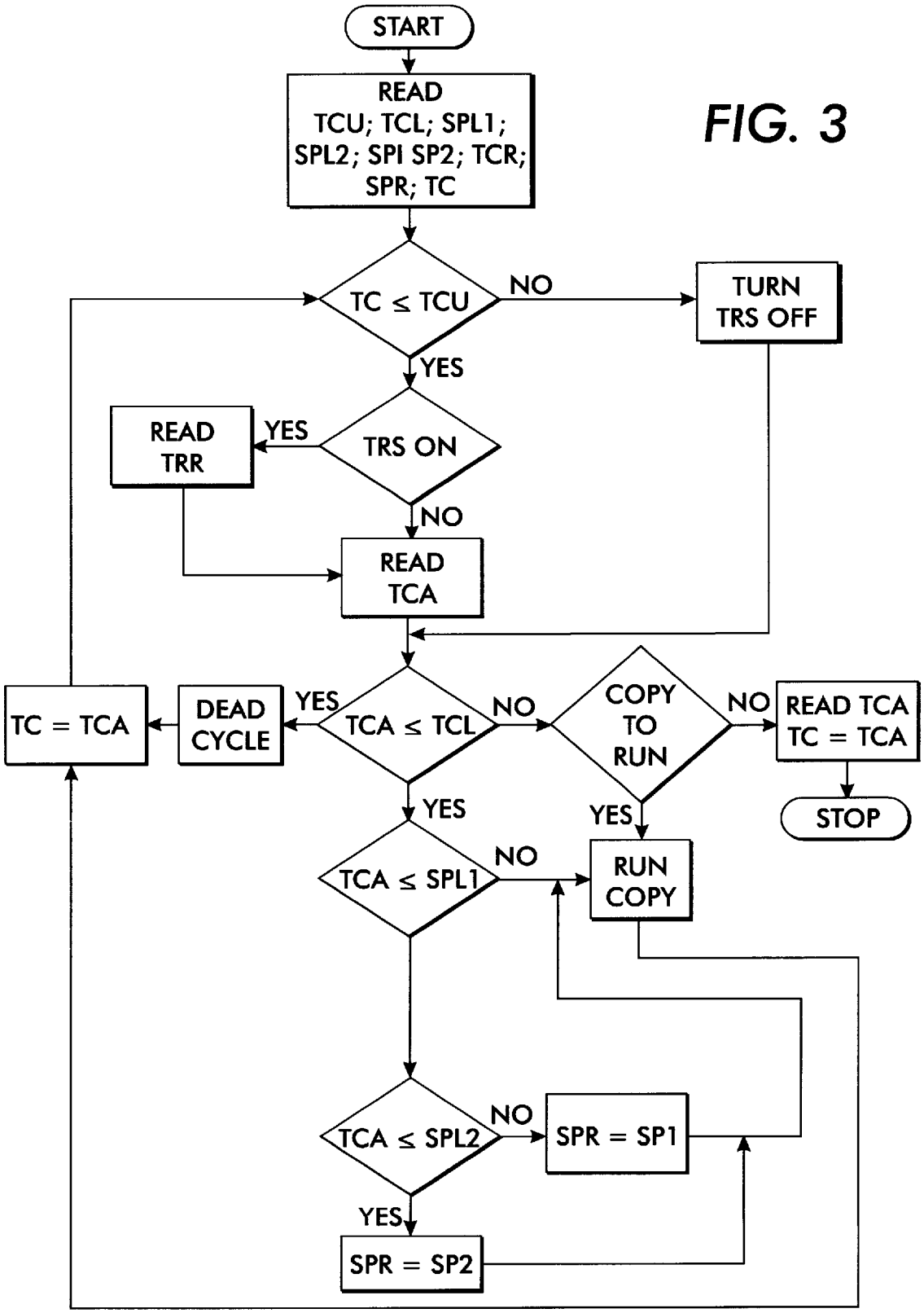
FIG. 3 is a flow chart representation of the method and apparatus of the present invention.

With reference now to FIGS. 1–5, and particularly FIG. 3, the distributed pitch skipping method and apparatus of the present invention is shown generally as 300 and includes the toner concentration control apparatus 200, and a dedicated controller 80A of ESS 80. From FIG. 3, TCU is an upper toner concentration (TC) limit for each developer housing 26, 42, 57, 67 above which fresh toner addition or TRR (toner replenishment rate) is stopped. TCL is the lowest TC limit for each developer housing at and below which toner image reproduction or machine productivity is stopped, and the particular developer housing, and hence the machine, "dead cycles. TCR is a TC limit between TCU and TCL, above which the machine can run at a 100% rate of productivity. SPL1, SPL2, . . . SPLN, are a plurality of programmed TC limits between TCR and TCL, above and below which distributive skipped pitch/print control is implemented in accordance with the present invention.

Still referring to FIG. 3, SPR in general is a skipped pitch/print rate which in accordance with the present invention can be SP1, SP2, . . . , SPN corresponding of course to the programmed TC limits SPL1, SPL2, . . . SPLN. TCA is the actual toner concentration calculation at any given time, and TC is the toner concentration in general including the desired value at which each developer housing is to be controlled. TRS is the toner replenisher status, which is either "on" or "off".

Thus in an electrostatographic toner image reproduction machine (the machine), the method of the present invention for stabilizing productivity includes establishing a first toner concentration (TC) limit TCL at and below which toner image reproduction of the machine stops and the machine dead cycles; establishing a second TC limit, TCR which is higher than the first TC limit TCL, and above which the toner image reproduction rate of the machine is 100% at ST ppm (Standard prints per minute). The method then includes adding fresh toner into a developer housing 26, 42, 57, 67 of the machine in an attempt to maintain the TC of the developer housing above the second TC limit TCR, while running copies or making toner image reproductions having various toner area coverage levels.

Finally, the method includes establishing at least a third TC limit SPL1, SPL2, . . . , SPLN, between the second TC limit TCR and the first TC limit TCL, with PL1 being closest to TCR, and SPLN being closest to TCL. Where there is only one such third limit SPL1, it is established such that above it (and hence below TCR) the toner image reproduction rate is less than 100% at (ST-X1) ppm, and below it the toner image reproduction rate is less than 100% at (ST-X2) ppm, where X1 and X2 are integers, X1 is greater than zero, and X2 is greater than X1. This ensures continuous but slowly decreasing productivity and toner depletion, thereby deterring the toner concentration of the particular developer housing 26, 42, 57, 67, from reaching the first TC limit TCL and thus causing the machine to dead cycle, resulting in unstable, stop and start machine productivity.

In the case of a single third TC limit SPL1, it can for example be established at the halfway or midway point between the first TC limit TCL, and the second and higher TC limit TCR. Further, X1 ppm and X2 ppm are each a distributed skipped pitch or skipped print rate, and is implemented at (ST-X1) ppm and (ST-X2) ppm respectively, by skipping a print every (ST/X1)−1 prints, and (ST/X2)−1 prints, respectively. For example, where ST ppm is 100 prints per minute and X1 is 10, (ST-X1) ppm will be implemented by skipping a print every (100/10)−1 prints, or every 9 prints. In according to the present invention, X2 which is greater than X1 and is implementable below the third TC limit (in the case of a single such limit) can be as large as 80% of ST ppm. Thus when implemented, the machine productivity will gradually but continuously slow down to 20% of ST.

However, in accordance with the present invention, a plurality of third TC limits SPL1, SPL2, . . . , SPLN is preferred. In such a case, the method of the present invention finally includes establishing a plurality of "N" such TC limits between the second TC limit TCR and the first TC limit TCL. They are established such that below each of them, SPL1, SPL2, . . . , SPLN, the toner image reproduction rate is less than 100% decreasing to (ST-X2) ppm, (ST-X3) ppm, . . . , and down to (ST-XN+1) ppm, where X2, X3 . . . and XN+1 are integers, and have an increasing order in magnitude from X2 to XN+1. This clearly ensures continuous but slowly decreasing productivity and toner depletion, thereby deterring the toner concentration of the particular developer housing 26, 42, 57, 67, from reaching the first TC limit TCL and thus causing the machine to dead cycle, resulting in unstable, stop and start machine productivity.

Thus the apparatus 300 for stabilizing productivity of the electrostatographic toner image reproduction machine 8 includes the mechanism (replenisher 129) for adding fresh toner into a developer housing 26, 42, 57, 67 of the machine; the toner concentration (TC) control system 200 having a first TC limit TCL at and below which toner image reproduction of the machine stops and the machine dead cycles, a second TC limit TCR higher than the first TC limit TCL, and above which the toner image reproduction rate is 100% at ST ppm (Standard prints per minute). The apparatus 300 also includes at least a third TC limit SPL1, SPL2, . . . , SPLN between the first TC limit TCL and the second TC limit TCR, and a controller 80A that is programmed to distributively reduce the toner image reproduction rate from ST ppm by X1 ppm when the toner concentration is below the second TC limit TCR but above the first third TC limit SPL1. The controller is also programmed to distributively reduce the toner image reproduction rate ST ppm by X2 ppm when the toner concentration is below SPL1 but above SPL3, and ST by XN+1 when the toner concentration is below SPLN but above TCL, where X1, X2, X3, . . . , XN+1 are integers, and increase in magnitude from X1 to XN+1. As pointed out above, this ensures continuous but slowly decreasing productivity (actual prints per minute), and toner depletion, thereby deterring the toner concentration of the particular developer housing 26, 42, 57, 67, from reaching the first TC limit TCL and thus causing the machine to dead cycle, resulting in unstable, stop and start machine productivity.

Thus by including the distributive pitch skipping method and apparatus 300 for stabilizing productivity in accordance with the present invention, the machine 8 is deterred, if not prevented from "dead cycling", and thus operator satisfaction is assured.

Material characteristic considerations, prevent the toner dispenser or replenisher 129 from providing more than 20 g/min of fresh toner, which is sufficient to sustain long job runs if job sheets are being toned at only a 50% area coverage. Unfortunately however, the different types of jobs being run by a customer cannot be so restricted, and can and do include sheet jobs with area coverages up to 100%, which amounts to toner depletion or usage at a rate of 40 g/min. In such cases, the job demand for toner clearly exceeds the maximum toner replenishment capability of the toner dispenser 129, and as a consequence the toner concentration TC will drop, and will eventually reach the low limit TCL where the image quality will begin to suffer.

"Dead cycling" as such allows the machine, particularly the toner replenisher—to recover, and a second limit TCR (recovery limit from dead cycling, which is a little higher than TCL) at which the machine would come out of the dead cycle and then resume the customer's job. The gap or range between the second limit TCR and the first limit TCL is for making sure (1) that the machine does not constantly and frequently keep entering the "dead cycle" mode after running just a few sheets or prints, and (2) that the machine does not continue to operate at or near the very low end of the acceptable toner concentration range TCL.

Advantages=(1) the amount or number of long term (i.e. greater than 1 minute) dead cycling that occur will be significantly reduced, thereby minimizing the amount of wasted toner needed to prevent damage to the materials, and (2) the toner concentration will be deterred from, and maintained well away from, the outer TC limit or failure boundary (TCL).

Referring now to FIGS. 2, 4 and 5, toner concentration (TC) results and machine productivity results are illustrated graphically. In FIG. 2, the toner concentration variations over time in any of the developer houses 26, 42, 57, 67,of the machine 8 under the distributive pitch skipping method of the present invention, are illustrated. FIG. 4 is a comparative graphical illustration of T C variations over time between a "Dead Cycling" method (plot line 306), and the productivity stabilizing distributive pitch skipping method of the present invention (plot line 308), at 100% area coverage and a 50% replenishment rate. FIG. 5 is a comparative graphical illustration (of productivity of the machine of FIG. 4) between the "Dead Cycling" method (plot line 312), and the productivity stabilizing distributive pitch skipping method of the present invention (plot line 314).

In FIG. 2, the at least third TC limit SPL1, called the skip limit, is shown arbitrarily set at the mean between the inner or higher TC limit TCR and the outer or lower TC limit TCL. The at least third TC limit SPL1 can be the toner concentration limit at which skipping pitches is started, such skipping can start at TCR given a declining TC trend. As pointed out above, at TC levels higher than TCR, the machine should be run at full capability or at 100% (ST ppm). The at least third TC limit SPL1 is also the steady state TC operating point during pitch skipping. As shown in FIG. 4, when the machine is run at 100% until the TC reaches TCL at which it dead cycles and allows TC to recover to TCR for resumption of productivity again at 100%, the result is plot line 306. It has been found that despite the up and down swings, during such dead cycling and running thereafter, the machine sustains an average TC that is essentially at the midpoint between TCR and TCL (show these on FIG. 4).

Unfortunately each machine cannot be set up using skip pitches in this manner. In a real machine the customer's area coverage is known (via pixel counting from the image path) and the inner, outer, and skip limits can be set as fixed toner concentrations or deltas from the TC target. The toner dispense rate is not so easily known since the amount of toner (in g/min) dispensed varies over time, environment conditions, toner size distributions, carrier loading along with fresh toner. What is known is the toner concentration as read by the sensor, S1, S2, S3 and S4. So in accordance with the present invention, the crux of this invention the skip pitch rate (SPR=SP1, SP2, SP3, . . . , SPN) is varied or adjusted in order to maintain the TC at the skip limit or higher. Thus when TC is above the skip limit SPL1, and the dispenser or replenisher 129 can keep up, the machine can be run at 100% capability without skipping. The machine of course should be run at 100% capability without skipping when TC is above TCR.

However, when TC is at or below the skip limit SPL1, and the dispenser or replenisher 129 cannot keep up, the machine will adjust and skip pitches in order to maintain the TC at the skip limit SPL1 or above. In the case where there are a plurality of skip limits, SPL1, SPL2, . . . , SPLN, with corresponding skip rates SP1, SP2, SP3, . . . , SPN, and the dispenser 129 is running at maximum output, then a proper number of pitches, X1, X2, . . . , XN+1 (as described above) should be skipped distributively in order to maintain the TC above TCL. As the customer demand changes, the skip rate SP1, SP2, SP3, . . . , SPN should change to maintain the TC above TCL.

When TC is below the skip limit SPL1 but the dispenser 129 has extra capacity to keep up and TC is actually increasing due to a drop in the toner depletion rate, then the machine may be run at 100% capability without skipping, or if there are lower skip rates available, then the skip rate should be reduced, for example, from X2 ppm to X1 ppm. Consequently, as the skip rate is reduced, machine productivity will slowly increase until it reaches 100% at ST ppm again.

As a final note, since the skip pitch rate is a surrogate for the actual toner dispense rate, instead of declaring a fault when the dispense rate reaches some minimum value, say 20%, an identical but more accurate fault could be declared when the machine net output rate falls below the same value 20% of ST ppm. The reason this approach is better is that it allows the system to run without declaring a fault if the dispenser is performing below 20% and the customer is running below 100% area coverage. Thus a dispenser running at 10% capability, while clearly a fault situation, would still provide the customer prints at 100% of the machine rated output if the area coverage demand was below 10%.

As can be seen, there has been provided a distributive pitch skipping method and apparatus for stabilizing productivity in an electrostatographic printing machine. The method and apparatus provide for establishing a first toner concentration (TC) limit at and below which toner image reproduction of the machine stops and the machine dead cycles; establishing a second TC limit, higher than the first TC limit, above which the toner image reproduction rate of the machine is 100% at ST ppm (Standard prints per minute); adding fresh toner into a developer housing of the machine in an attempt to maintain the TC of the developer housing above the second TC limit while running copies having various toner area coverage levels; and establishing at least a third TC limit, between the first TC limit and the second TC limit, above which the toner image reproduction rate is less than 100% at (ST-X1) ppm, and below which the toner image reproduction rate is less than 100% at (ST-X2) ppm, where X1 and X2 are integers, and X2 is greater than X1.

While this invention has been described in conjunction with a specific embodiment thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. A method of stabilizing productivity in an electrostatographic toner image reproduction machine (the machine), the method comprising:

(a) establishing a first toner concentration (TC) limit at and below which toner image reproduction of the machine stops and the machine dead cycles;

(b) establishing a second TC limit, higher than the first TC limit, above which the toner image reproduction rate of the machine is 100% at ST ppm (Standard Prints Per Minute);

(c) adding fresh toner into a developer housing of the machine in an attempt to maintain the TC of the developer housing above the second TC limit while running copies having various toner area coverage levels; and (d) establishing at least a third TC limit, between the first TC limit and the second TC limit, above which the toner image reproduction rate is less than 100% at (ST-X1) ppm, and below which the toner image reproduction rate is less than 100% at (ST-X2) ppm, where X1 and X2 are integers, and X2 is greater than X1, thereby deterring the toner concentration of the developer housing from reaching the first TC limit causing the machine to dead cycle, and thus stabilizing productivity of the machine.

2. The method of claim 1, wherein said at least third TC limit is established midway between said first TC limit and said second TC limit.

3. The method of claim 1, wherein X1 is greater than zero and less than X2.

4. The method of claim 2, wherein X1 ppm and X2 ppm are each a distributed skipped print rate and comprises skipping a print every (ST/X1)−1 prints and (ST/X2)−1 prints respectively, and X1 is an integer greater than zero.

5. Apparatus for stabilizing productivity of an electrostatographic toner image reproduction machine (the machine), the apparatus comprising:

(a) mechanism for adding fresh toner into a developer housing of the machine;

(b) a toner concentration (TC) control system having a first TC limit at and below which toner image reproduction of the machine stops and the machine dead cycles, a second TC limit higher than the first TC limit, and above which second TC limit the toner image reproduction rate is 100% at ST ppm (Standard prints per minute), and a third TC limit between the first TC limit and the second TC limit; and (c) a controller for reducing the toner image reproduction rate ST ppm by X1 ppm when the toner concentration is below the second TC limit but above the third TC limit, and reducing the toner image reproduction rate ST ppm by X2 ppm when the toner concentration is below the third TC limit but above the first TC limit, where X1 and X2 are integers, and X2 is greater than X1, thereby deterring the toner concentration of the developer housing from reaching the first TC limit causing the machine to dead cycle, and thus stabilizing productivity of the machine.

6. The apparatus of claim 5, wherein said third TC limit is midway between said first and said second TC limit.

7. An electrostatographic reproduction machine comprising:

(a) electrostatographic assemblies including a developer housing for producing toner images on copy sheets; and (b) apparatus for stabilizing productivity of an electrostatographic toner image reproduction machine (the machine), the apparatus comprising:

(i) mechanism for adding fresh toner into a developer housing of the machine;

(ii) a toner concentration (TC) control system having a first TC limit at and below which toner image reproduction of the machine stops and the machine dead cycles, a second TC limit higher than the first TC limit, and above which second TC limit the toner image reproduction rate is 100% at ST ppm (Standard prints per minute), and a third TC limit between the first TC limit and the second TC limit; and (iii) a controller for reducing the toner image reproduction rate ST ppm by X1 ppm when the toner concentration is below the second TC limit but above the third TC limit, and reducing the toner image reproduction rate ST ppm by X2 ppm when the toner concentration is below the third TC limit but above the first TC limit, where X1 and X2 are integers, and X2 is greater than X1, thereby deterring the toner concentration of the developer housing from reaching the first TC limit causing the machine to dead cycle, and thus stabilizing productivity of the machine.

8. A method of stabilizing productivity in an electrostatographic toner image reproduction machine (the machine), the method comprising:

(a) establishing a first toner concentration (TC) limit at and below which toner image reproduction of the machine stops and the machine dead cycles;

(b) establishing a second TC limit, higher than the first TC limit, above which the toner image reproduction rate of the machine is 100% at ST ppm (Standard Prints Per Minute);

(c) adding fresh toner into a developer housing of the machine in an attempt to maintain the TC of the developer housing above the second TC limit while running copies having various toner area coverage levels; and (d) establishing a plurality of "N" TC limits between the first TC limit and the second TC limit, below each of which the toner image reproduction rate is less than 100% at (ST-X2) ppm, (ST-X3) ppm, . . . , (ST-XN+1) ppm, where X2, X3 . . . and XN+1 are integers, and have an increasing order in magnitude from X2 to XN+1, thereby deterring the toner concentration of the developer housing from reaching the first TC limit causing the machine to dead cycle, and thus stabilizing productivity of the machine.

9. The method of claim 8, wherein the toner image reproduction rate is less than 100% at (ST-X1) ppm when the toner concentration is above said plurality of "N" TC limits and below the second TC limit, where X1 is an integer and less than X2.

10. The method of claim 8, wherein X1 is greater than zero.

11. The method of claim 8, wherein X2 ppm, X3 ppm, . . . XN+1 ppm are each a distributed skipped print rate and comprises skipping a print every (ST/X2)−1 prints, (ST/X3)−1 prints, . . . (ST/XN+1)−1 prints, respectively.

* * * * *